US010849820B2

(12) United States Patent
von Schenck et al.

(10) Patent No.: US 10,849,820 B2
(45) Date of Patent: Dec. 1, 2020

(54) CPR CHEST COMPRESSION DEVICE WITH LATERAL SUPPORT PAD

(71) Applicant: PHYSIO-CONTROL, INC., Redmond, WA (US)

(72) Inventors: Erik von Schenck, Lomma (SE); Anders Nilsson, Åkarp (SE); Marcus Ehrstedt, Kävlinge (SE); Anders Jeppsson, Lund (SE); Bjarne Madsen Härdig, Lund (SE)

(73) Assignee: PHYSIO-CONTROL, INC., Redmond, WA (US)

( * ) Notice: Subject to any disclaimer, the term of this patent is extended or adjusted under 35 U.S.C. 154(b) by 160 days.

(21) Appl. No.: 16/168,001

(22) Filed: Oct. 23, 2018

(65) Prior Publication Data

US 2019/0117498 A1 Apr. 25, 2019

Related U.S. Application Data

(60) Provisional application No. 62/575,970, filed on Oct. 23, 2017.

(51) Int. Cl.
*A61H 31/00* (2006.01)

(52) U.S. Cl.
CPC ... *A61H 31/004* (2013.01); *A61H 2201/0103* (2013.01); *A61H 2201/0134* (2013.01); *A61H 2201/0214* (2013.01); *A61H 2201/0278* (2013.01); *A61H 2201/1647* (2013.01)

(58) Field of Classification Search
CPC .... A61H 31/00; A61H 31/004; A61H 31/006; A61H 31/008; A61G 7/05715; A61G 13/1285; A47C 27/081
See application file for complete search history.

(56) References Cited

U.S. PATENT DOCUMENTS 3,782,371 A * 1/1974 Derouineau ..... A61H 31/007 601/41
5,490,820 A * 2/1996 Schock ..... A61H 9/0078 601/1
5,575,027 A * 11/1996 Mueller ..... A61G 7/07 128/845
6,701,553 B1 * 3/2004 Hand ..... A61G 7/008 5/428

(Continued)

FOREIGN PATENT DOCUMENTS

WO WO2014057116 A1 4/2014

*Primary Examiner* — Justine R Yu
*Assistant Examiner* — Christopher E Miller
(74) *Attorney, Agent, or Firm* — Miller Nash Graham & Dunn LLP

(57) ABSTRACT

A cardiopulmonary resuscitation ("CPR") device that includes a chest compression mechanism, a support structure, and a plurality of inflatable support pads. The chest compression mechanism is configured to deliver CPR chest compressions to a patient. The support structure includes a base member configured to be placed underneath a patient, and a leg configured to support the chest compression mechanism at a distance from the base member. The plurality of inflatable support pads are configured to provide lateral support to a patient's chest during use of the CPR device. Each support pad within the plurality of support pads includes a holder configured to retain and at least partially surround the adjacent support pad.

16 Claims, 6 Drawing Sheets

(56) References Cited

U.S. PATENT DOCUMENTS

| | | | | |
|---|---|---|---|---|
| 8,635,725 | B2 * | 1/2014 | Tannoury | A61G 13/0036 5/607 |
| 9,320,678 | B2 * | 4/2016 | Illindala | A61H 31/006 |
| 2001/0027577 | A1 * | 10/2001 | Frydman | A47C 20/021 5/648 |
| 2003/0004445 | A1 * | 1/2003 | Hall | A61H 9/0078 601/41 |
| 2003/0181834 | A1 * | 9/2003 | Sebelius | A61H 31/007 601/41 |
| 2004/0162510 | A1 * | 8/2004 | Jayne | A61H 31/008 601/41 |
| 2004/0162587 | A1 * | 8/2004 | Hampton | A61N 1/39044 607/5 |
| 2006/0288483 | A1 * | 12/2006 | Naslund | A61B 6/0421 5/601 |
| 2009/0020129 | A1 * | 1/2009 | Shaffer | A61H 31/006 128/845 |
| 2010/0063425 | A1 * | 3/2010 | King | A61H 31/008 601/41 |
| 2011/0170671 | A1 * | 7/2011 | Blyakher | A61B 6/0421 378/209 |
| 2015/0164725 | A1 * | 6/2015 | Wilson | A61G 13/129 128/845 |
| 2015/0272822 | A1 | 10/2015 | Wik et al. | |
| 2016/0066697 | A1 * | 3/2016 | Adams | A47G 9/1081 5/636 |
| 2018/0078437 | A1 * | 3/2018 | Panigada | A61G 7/075 |

* cited by examiner

CPR CHEST COMPRESSION DEVICE WITH LATERAL SUPPORT PAD

CROSS-REFERENCES TO RELATED APPLICATIONS

This patent application claims the benefit of provisional Application No. 62/575,970 filed Oct. 23, 2017, which is incorporated into the present disclosure by this reference.

FIELD OF THE INVENTION

This disclosure is directed to devices and methods for CPR machines that deliver CPR chest compressions to a patient.

BACKGROUND

Cardiopulmonary resuscitation (CPR) is a medical procedure performed on patients to maintain some level of circulatory and respiratory functions when patients otherwise have limited or no circulatory and respiratory functions. CPR is generally not a procedure that restarts circulatory and respiratory functions, but can be effective to preserve enough circulatory and respiratory functions for a patient to survive until the patient's own circulatory and respiratory functions are restored. CPR typically includes frequent torso compressions that usually are performed by pushing on or around the patient's sternum while the patient is lying on the patient's back. For example, torso compressions can be performed as at a rate of about 100 compressions per minute and at a depth of about 5 cm per compression for an adult patient. The frequency and depth of compressions can vary based on a number of factors, such as valid CPR guidelines.

Mechanical CPR has several advantages over manual CPR. A person performing CPR, such as a medical first-responder, must exert considerable physical effort to maintain proper compression timing and depth. Over time, fatigue can set in and compressions can become less consistent and less effective. The person performing CPR must also divert mental attention to performing manual CPR properly and may not be able to focus on other tasks that could help the patient. For example, a person performing CPR at a rate of 100 compressions per minute would likely not be able to simultaneously prepare a defibrillator for use to attempt to correct the patient's heart rhythm. Mechanical compression devices can be used with CPR to perform compressions that would otherwise be done manually. Mechanical compression devices can provide advantages such as providing constant, proper compressions for sustained lengths of time without fatiguing, freeing medical personnel to perform other tasks besides CPR compressions, and being usable in smaller spaces than would be required by a person performing CPR compressions.

Embodiments of the disclosed technology address shortcomings in existing devices and methods.

DETAILED DESCRIPTION

As described herein, embodiments provide lateral support to a patient within a mechanical CPR device. This provides the benefit of allowing a single CPR device (or size for the CPR device) to be used on patients having chests of different widths. Hence, for example, the disclosed technology may allow the CPR device to be used on patients having average chest widths, smaller than average chest widths, and larger than average chest widths. By including one or more support pads between a patient's chest and the support structure of the CPR device, the patient's chest may receive lateral support and stability. The support pads may be included on one or two sides of the patient's chest. In addition, when one or more support pads are used, the support pads may allow the CPR device to be tilted, such as during patient transport, while maintaining the patient in a desired position within the CPR device to continue mechanical CPR procedures.

Figure 1:
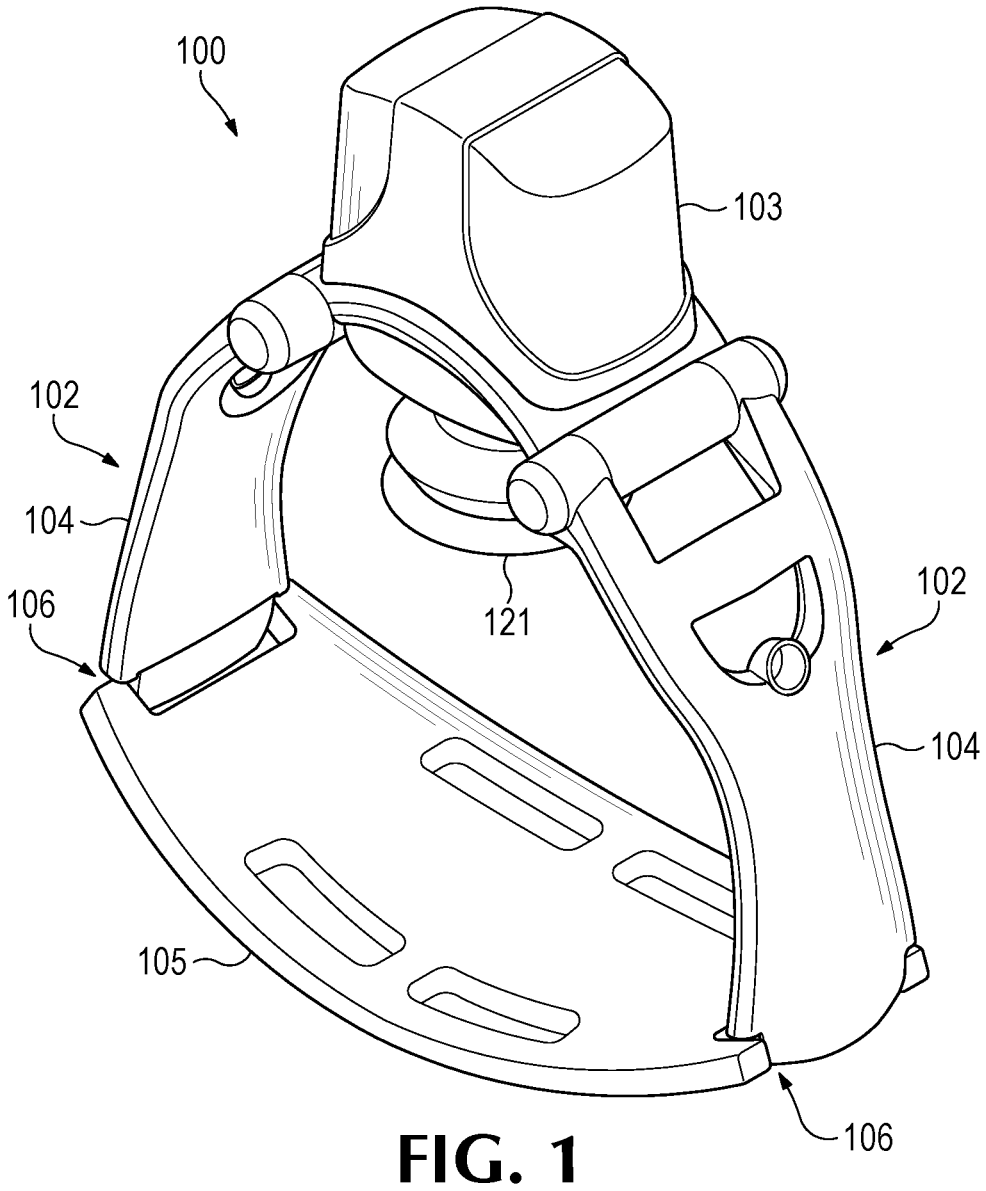
FIG. 1 is a perspective view of a CPR device, according to embodiments.
Figure 2:
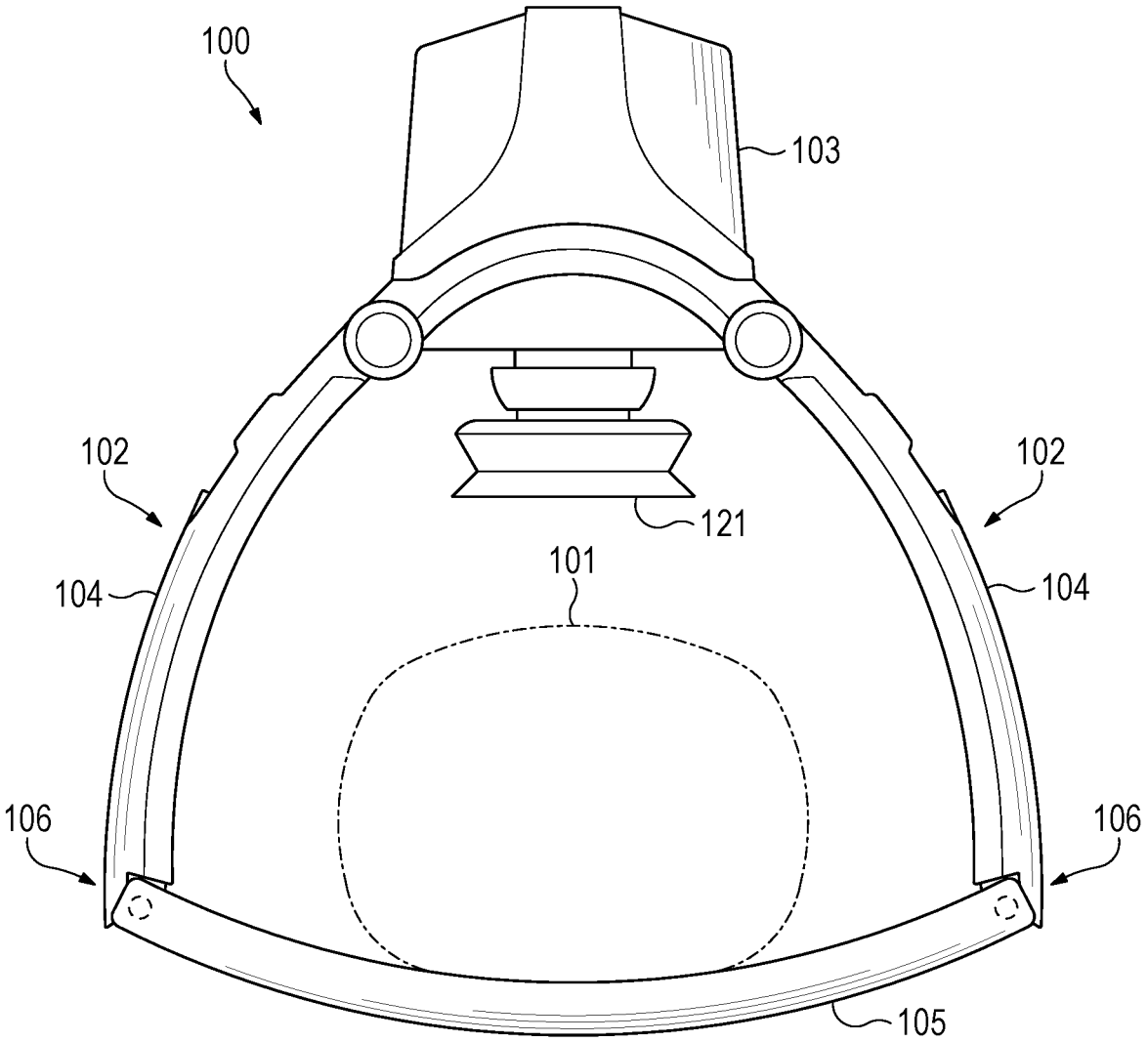
FIG. 2 is a front view of the CPR device of FIG. 1, also showing a representation of a patient within the CPR device.

FIG. 1 is a perspective view showing portions of a CPR device 100, according to embodiments. FIG. 2 is a front view of the CPR device 100 of FIG. 1, also showing a representation of a patient 101 within the CPR device 100. As illustrated in FIGS. 1 and 2, a CPR device 100 may include a support structure 102 and a chest compression mechanism 103. The support structure 102 may include a support leg 104 and a base member 105. The support leg 104 and the base member 105 meet at a junction 106 between the support leg 104 and the base member 105.

The chest compression mechanism 103 may be configured to deliver CPR chest compressions to the patient 101. The chest compression mechanism 103 may include, for example, a motor-driven piston 121 configured to contact the patient's chest to provide the CPR chest compressions.

The base member, or back plate, 105 may be configured to be placed underneath the patient 101, for example when the patient 101 is lying on the patient's back.

The support leg 104 may be configured to support the chest compression mechanism 103 at a distance from the base member 105. For example, if the base member 105 is underneath the patient 101, who is lying on the patient's back, then the support leg 104 may support the chest compression mechanism 103 at a sufficient distance over the base member 105 to allow the patient 101 to lay within a space between the base member 105 and the chest compression mechanism 103, while positioning the chest compression mechanism 103 over the patient's chest.

In embodiments, there may be two support legs 104. In embodiments, the two support legs 104 may together form an arch to support the chest compression mechanism 103. An example of such a configuration is illustrated in FIGS. 1-2.

Figure 3B:
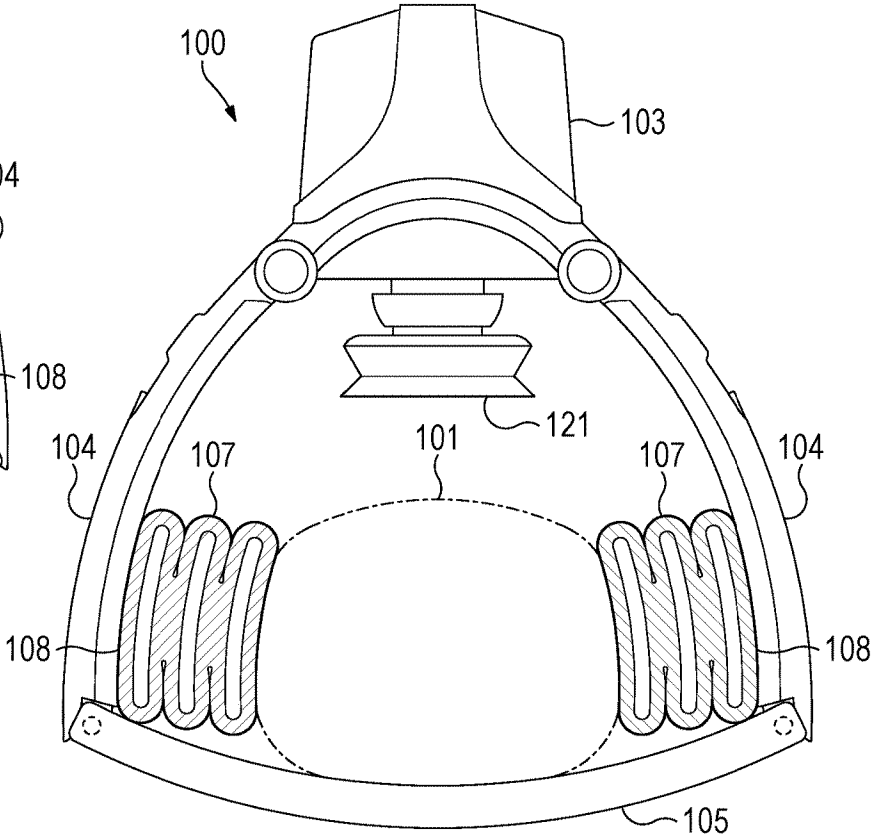
FIG. 3B is a front view of the CPR device of FIG. 3A, showing the plurality of support pads in a compressed state, providing lateral support to the patient.
Figure 3A:
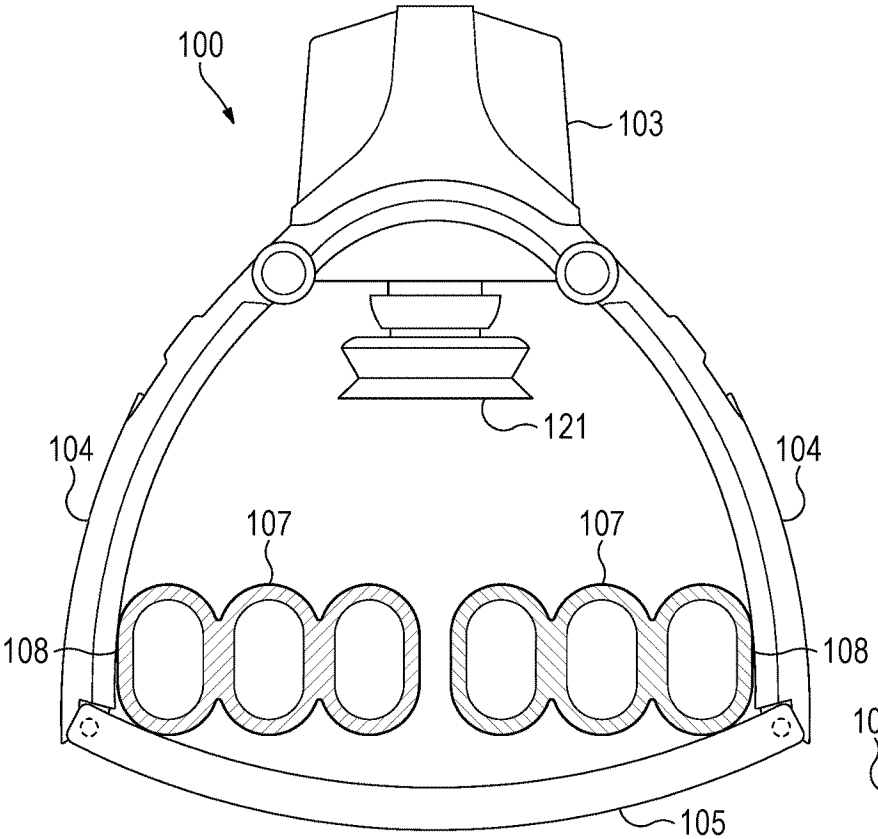
FIG. 3A is a front view of the CPR device of FIG. 1, showing a plurality of support pads in an uncompressed state, according to embodiments.

FIG. 3A is a front view of the CPR device 100 of FIG. 1, showing a plurality of support pads 107 in an uncompressed state, according to embodiments. FIG. 3B is a front view of the CPR device 100 of FIG. 3A, showing the plurality of support pads 107 in a compressed state. As illustrated in FIGS. 3A and 3B, there may be a separate plurality of support pads 107 on each side of the patient 101.

Although depicted in the figures as a plurality of support pads, in embodiments there may be a single support pad on each side of the patient 101. Also, in embodiments there may be a single support pad or a single plurality of support pads on one side of the patient 101, with no support pad or pads on the other side of the patient 101.

As illustrated in FIGS. 3A and 3B, the support pads 107 may be disposed at the junction 106 between the support leg 104 and the base member 105 of the support structure 102. The support pads 107 may be affixed to the support structure 102 by, for example, a fastener 108. The fastener 108 may be, for example, an adhesive fastener, such as glue, or a mechanical fastener, such as a rivet, threaded fastener, or weld.

The support pads 107 may be removably attached to the support structure 102. As examples, support pads 107 may be attached to the support structure 102 by a hook and loop fastener, snap fastener, strap, or detachable clip. Examples of detachable clips are shown in FIGS. 6C and 7C discussed below.

The support pads 107 may be configured to provide lateral support to a patient's chest during use of the CPR device 100. For example, the compressed support pads 107, such as shown in FIG. 3B, may apply a force to the sides of the patient's chest, and this lateral force may counteract the force tending to compress the support pads 107. Accordingly, the support pads 107 may cushion the sides of the patient's chest and provide a stabilizing force during CPR chest compressions.

In embodiments, the support pads 107 may be inflatable. Accordingly, the support pads 107 may be inflated with air, gas, or another fluid.

In embodiments, the support pads 107 may be or include a polymeric bag or casing. In embodiments, the support pads 107 may be or include foam, such as foam rubber or polyfoam. As used here, a polyfoam is a rigid, semi-rigid, or rubbery foam made of minute bubbles of air or gas embedded in a polymer matrix, such as polyurethane.

In embodiments, the support pads 107 may include cooling elements, such as ice packs or chemical substances to be activated when cooling the patient 101 is desired. In embodiments, the support pads 107 may include one or more batteries to, for example, provide additional power to the chest compression mechanism 103 or other electrical features of the CPR device 100. In embodiments, the support pads 107 may include one or more electric lights to facilitate work during low-light conditions. In embodiments, the support pads 107 may be brightly colored or include reflective materials for higher visibility.

Figure 4:
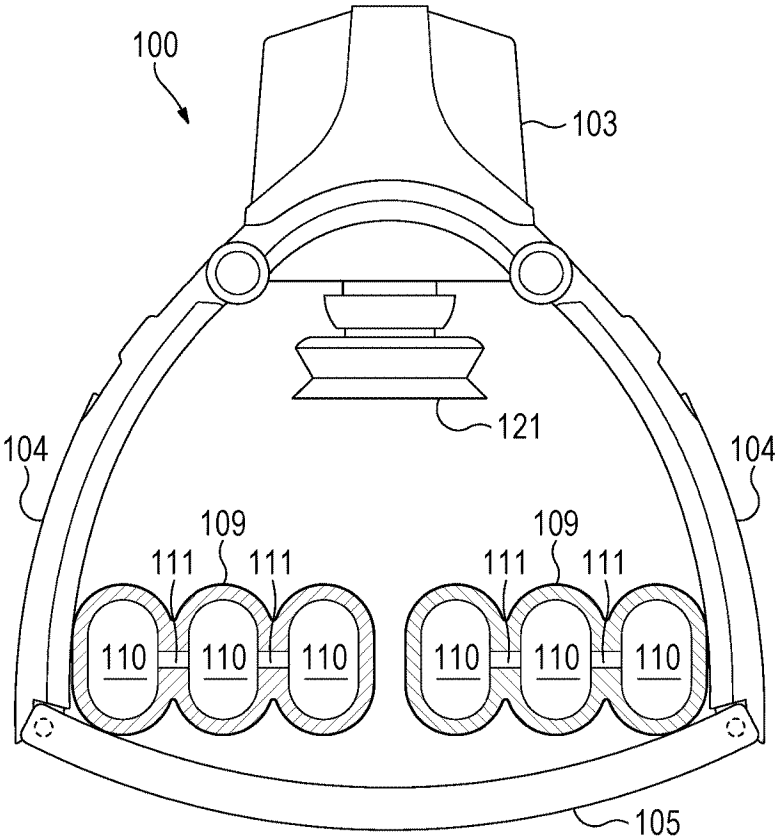
FIG. 4 is a front view of the CPR device of FIG. 1, showing support pads in an uncompressed state, according to embodiments.

FIG. 4 is a front view of the CPR device 100 of FIG. 1, showing support pads 109 in an uncompressed state, according to embodiments. The support pads 109 of FIG. 4 are generally as described above for the support pads 107 of FIGS. 3A and 3B, including the options and features described, except as noted here. Specifically, the inflatable support pad 109 of FIG. 4 may include a plurality of inflatable chambers 110. Thus, for example, the support pad 109 may include multiple inflatable chambers interconnected by passageways 111, such as shown in FIG. 4. The multiple inflatable chambers may provide additional stability and cushion to the patient's chest (when compared to a single inflatable chamber in a single cushion), while only requiring one inlet valve.

Figure 5:
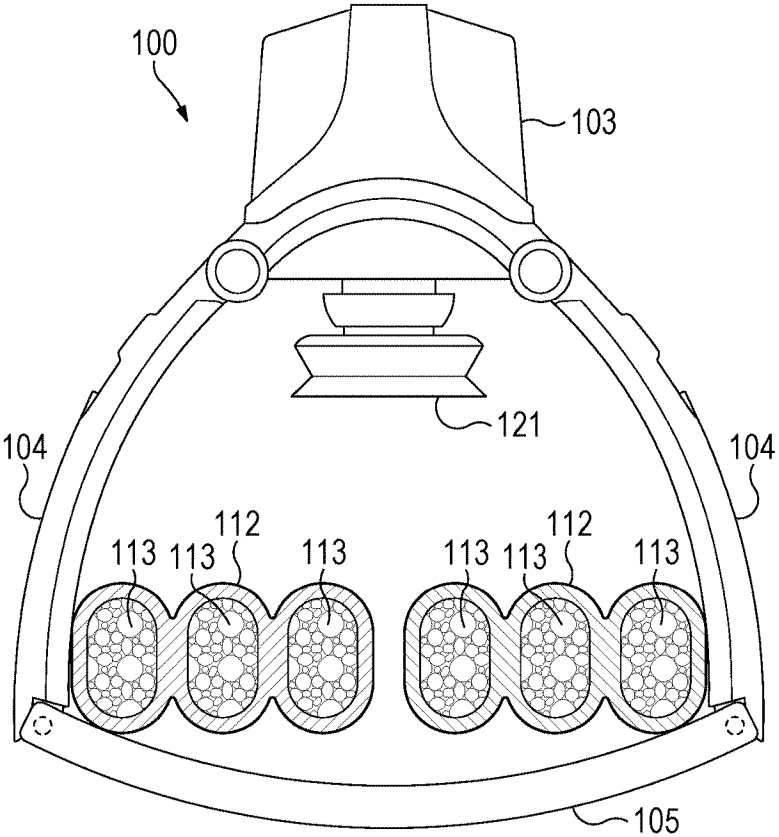
FIG. 5 is a front view of the CPR device of FIG. 1, showing a plurality of support pads in an uncompressed state, according to embodiments.

FIG. 5 is a front view of the CPR device 100 of FIG. 1, showing a plurality of support pads 112 in an uncompressed state, according to embodiments. The support pads 112 of FIG. 5 are generally as described above for the support pads 107 of FIGS. 3A and 3B and the support pads 109 of FIG. 4, including the options and features described, except as noted here. Specifically, the inflatable support pads 112 of FIG. 5 may each include a foam support pad 113 within the inflatable support pad 112.

The foam support pad 113 may be or include foam rubber or polyfoam having a tendency to return to a pre-loaded condition after a compressive load is removed. Accordingly, the foam support pad 113 may help the inflatable support pad 112 to at least partially self-inflate. To do so, the foam support pad 113 may expand, drawing air, gas, or another fluid into the inflatable support pad 112 through, for example, an inlet valve. Once expanded, the inlet valve may be closed, preventing the air, gas, or other fluid from escaping from the inflatable support pad 112.

Figure 6A:
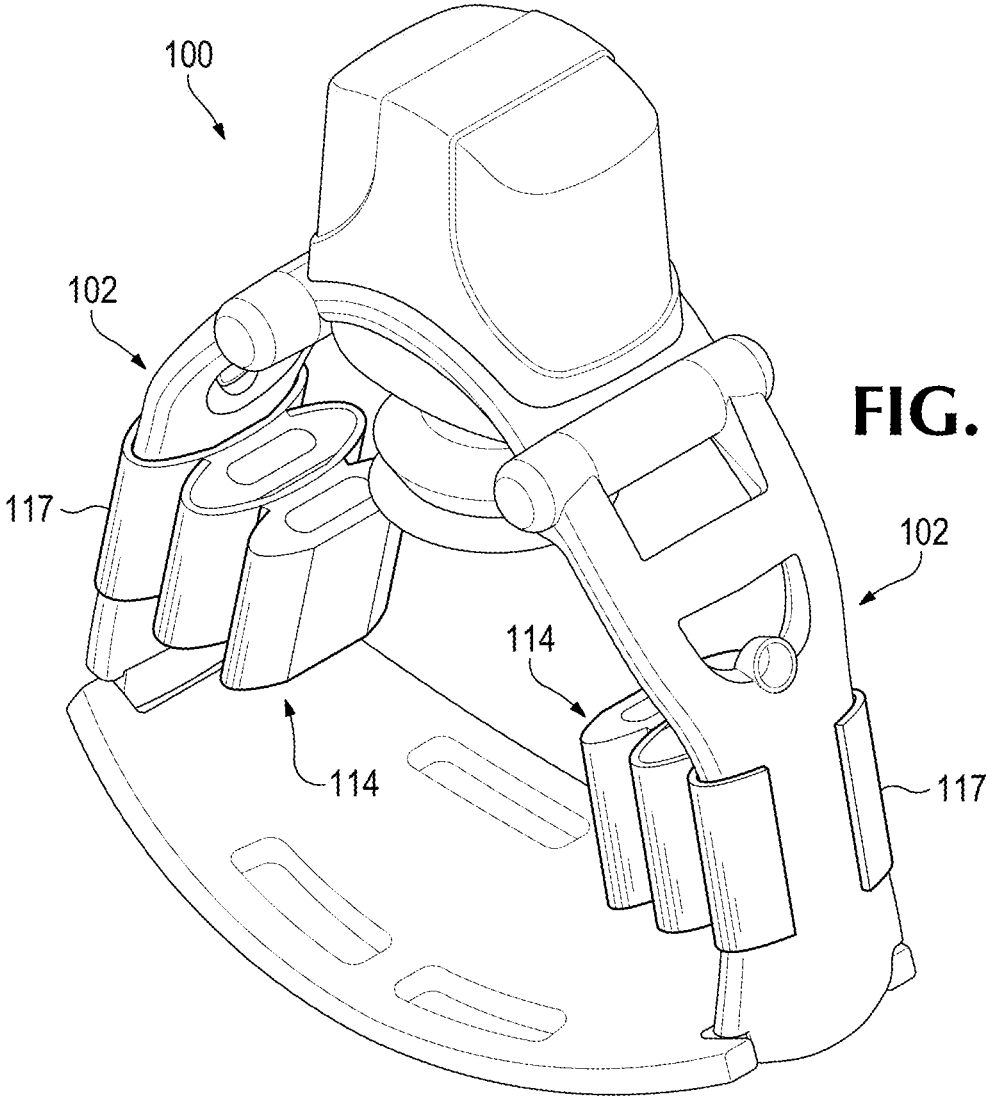
FIG. 6A shows multiple stacked support pads attached to the support structure of the CPR device of FIG. 1.
Figure 6B:
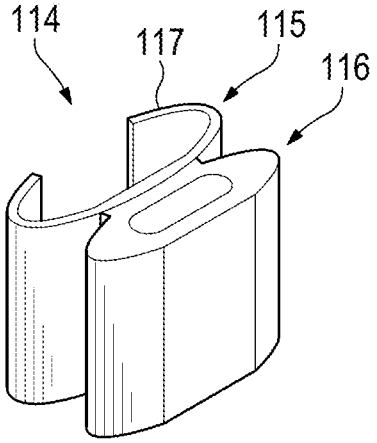
FIG. 6B shows an example of a stackable support pad in isolation, according to embodiments.
Figure 6C:
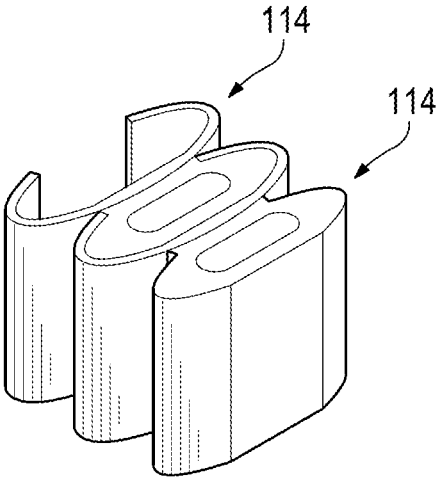
FIG. 6C shows two stackable support pads stacked together.

FIG. 6A shows multiple stacked support pads 114 attached to the support structure 102 of the CPR device 100 of FIG. 1. FIG. 6B shows an example of a stackable support pad 114 in isolation, according to embodiments. FIG. 6C shows two stackable support pads 114 stacked together.

The support pads 114 of FIGS. 6A-6C are generally as described above for the support pads 107 of FIGS. 3A and 3B, the support pads 109 of FIG. 4, and the support pads 112 of FIG. 5, including the options and features described above, except as noted here.

As illustrated in FIGS. 6A-6C, a support pad 114 might include a clip portion 115. The clip portion 115 may, for example, be affixed to a pad portion 116 of the support pad 114. The clip portion 115 may be configured to couple the support pad 114 to an adjacent support pad 114. An example of this is shown in FIG. 6B. Accordingly, the clip portion 115 may be configured, for example, to interconnect to the adjacent support pad 114. As an example, the clip portion 115 may include a holder 117 configured to retain the adjacent support pad 114. The holder 117 may retain the adjacent support pad 114 by, for example, at least partially surrounding the adjacent support pad 114. FIG. 6C illustrates the holder substantially surrounding the adjacent support pad 114.

The clip portion 115 may be configured to removably attach the support pad 114 to the support structure 102 of the CPR device 100. Hence, for example, the holder 117 may also be configured to engage the support structure 102 such as, for example, by at least partially surrounding a portion of the support structure 102, including a portion of the support leg 104 or a portion of the base member 105. In embodiments, the clip portion 115 may slidingly engage the support structure 102, allowing the support pad 114 to be positioned relative to the patient 101.

In embodiments, the support pads 114 of FIGS. 6A-6C may be inflatable support pads. In embodiments, the support pads 114 of FIGS. 6A-6C may be or include foam, such as foam rubber or polyfoam. In embodiments, the support pads 114 of FIGS. 6A-6C may be or include a foam support pad 113 within an inflatable support pad 114, similar to what is described above for FIG. 5.

Figure 7A:
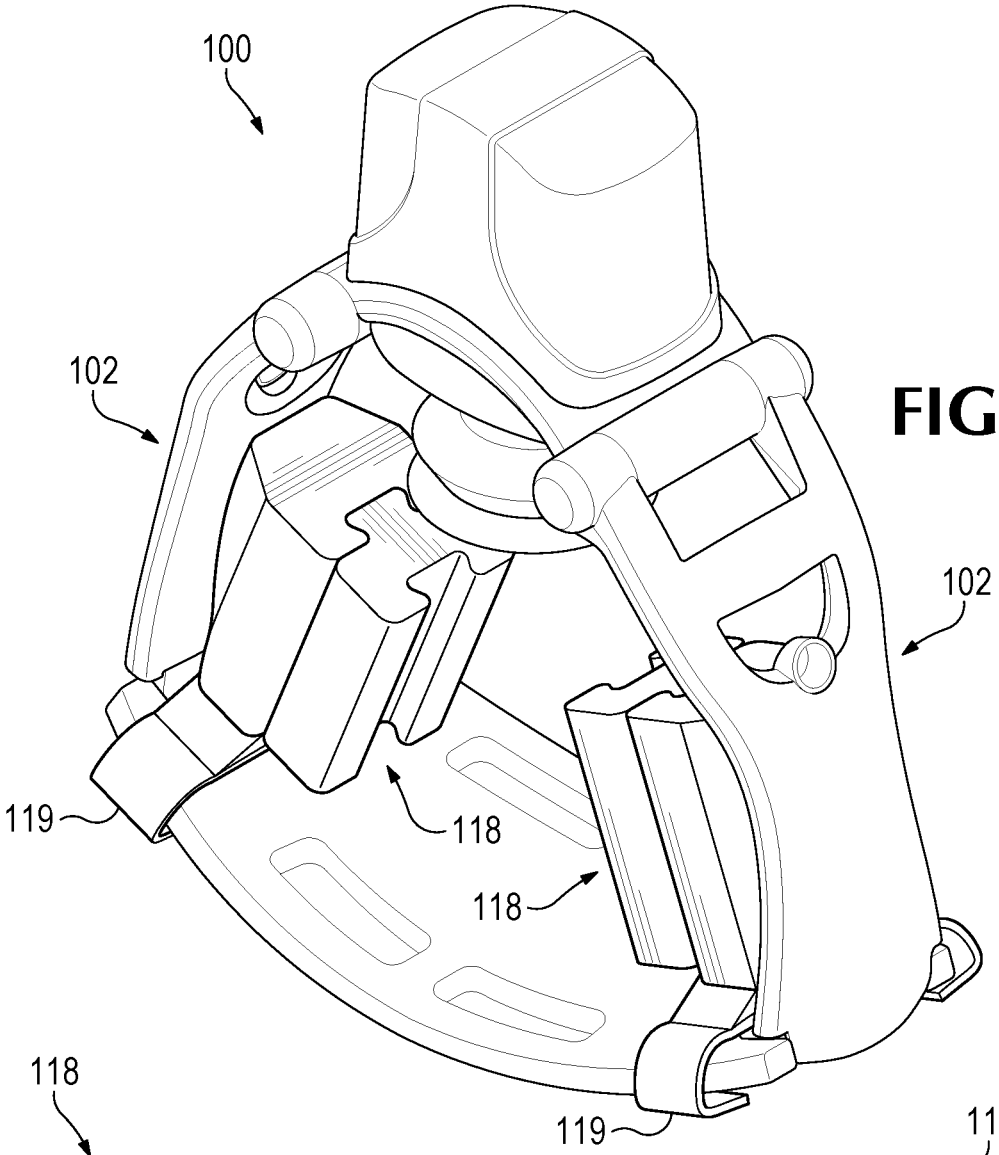
FIG. 7A shows multiple interlocked support pads attached to the support structure of the CPR device of FIG. 1.
Figure 7B:
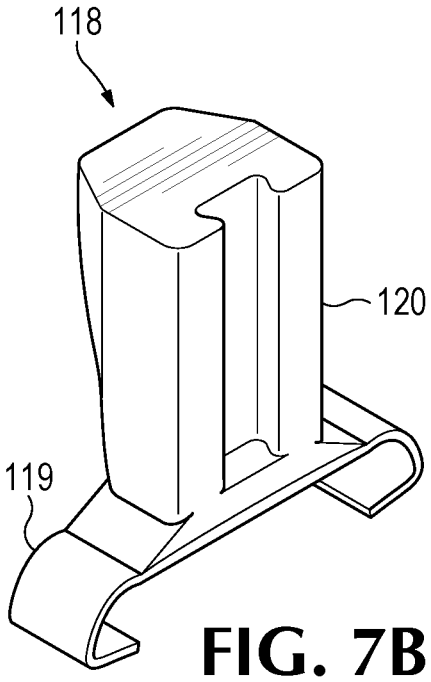
FIG. 7B shows an example of an interlock-able support pad in isolation, according to embodiments.
Figure 7C:
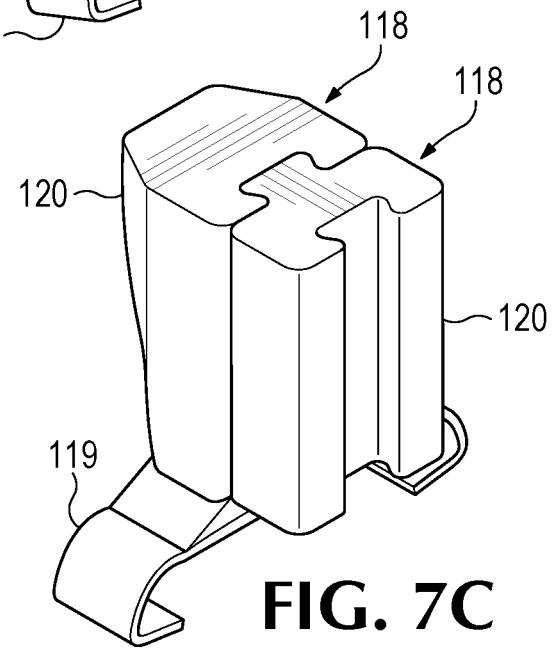
FIG. 7C shows two interlock-able support pads interlocked together.

FIG. 7A shows multiple interlocked support pads 118 attached to the support structure 102 of the CPR device 100 of FIG. 1. As illustrated, each support pad 118 may interlock with an adjacent support pad 118. FIG. 7B shows an example of an interlock-able support pad 118 in isolation, according to embodiments. FIG. 7C shows two interlock-able support pads 118 interlocked together.

The support pads 118 of FIGS. 7A-7C are generally as described above for the support pads 107 of FIGS. 3A and 3B, the support pads 109 of FIG. 4, and the support pads 112 of FIG. 5, including the options and features described above, except as noted here.

As illustrated in FIGS. 7A-7C, a support pad 118 might include a clip portion 119. The clip portion 119 may, for example, be affixed to a pad portion 120 of the support pad 118. The clip portion 119 may be configured to removably attach the support pad 118 to the support structure 102 of the CPR device 100, such as, for example, by at least partially surrounding a portion of the support structure 102, including a portion of the support leg 104 or a portion of the base member 105. In embodiments, the clip portion 119 may slidingly engage the support structure 102, allowing the support pad 118 to be positioned relative to the patient 101.

The support pads 118 of FIGS. 7A-7C may be or include foam, such as foam rubber or polyfoam.

Accordingly, as described above, embodiments may provide lateral support and stability to the patient within the CPR device. This may allow the CPR device to be used on patients having chests with small widths, average widths, and large widths. Embodiments may also allow the CPR device to be tilted, such as during patient transport, while keeping the patient centered within the CPR device for continued mechanical CPR chest compressions.

Examples

Illustrative examples of the disclosed technologies are provided below. An embodiment of the technologies may include one or more, and any combination of, the examples described below.

Example 1 includes a cardiopulmonary resuscitation ("CPR") device, comprising: a chest compression mechanism configured to deliver CPR chest compressions to a patient; a support structure comprising: a base member configured to be placed underneath a patient, and a leg configured to support the chest compression mechanism at a distance from the base member; and a plurality of inflatable support pads disposed at a junction between the leg and the base member and configured to provide lateral support to a patient's chest during use of the CPR device.

Example 2 includes the CPR device of Example 1, in which the plurality of inflatable support pads is affixed to the support structure.

Example 3 includes the CPR device of Example 1, in which the plurality of inflatable support pads is removably attached to the support structure.

Example 4 includes a cardiopulmonary resuscitation ("CPR") device, comprising: a chest compression mechanism configured to deliver CPR chest compressions to a patient; a support structure comprising: a base member configured to be placed underneath a patient, and a leg configured to support the chest compression mechanism at a distance from the base member; and a support pad removably connected to the support structure and configured to provide lateral support to a patient's chest during use of the CPR device.

Example 5 includes the CPR device of Example 4, in which the support pad is disposed at a junction between the leg and the base member.

Example 6 includes the CPR device of any of Examples 4-5, in which the support pad comprises an inflatable support pad.

Example 7 includes the CPR device of Example 6, in which the inflatable support pad comprises a plurality of inflatable chambers.

Example 8 includes the CPR device of any of Examples 4-5, in which the support pad comprises a foam support pad.

Example 9 includes the CPR device of any of Examples 4-5, in which the support pad comprises a foam support pad within an inflatable support pad.

Example 10 includes a cardiopulmonary resuscitation ("CPR") device, comprising: a chest compression mechanism configured to deliver CPR chest compressions to a patient; a support structure comprising: a base member configured to be placed underneath a patient, and a leg configured to support the chest compression mechanism at a distance from the base member; and a plurality of support pads configured to provide lateral support to a patient's chest during use of the CPR device, each support pad within the plurality of support pads being coupled to an adjacent support pad of the plurality of support pads.

Example 11 includes the CPR device of Example 10, in which each support pad within the plurality of support pads interlocks with the adjacent support pad of the plurality of support pads.

Example 12 includes the CPR device of Example 11, in which one of the support pads in the plurality of support pads is affixed to the support structure.

Example 13 includes the CPR device of Example 11, in which one of the support pads in the plurality of support pads is removably attached to the support structure.

Example 14 includes the CPR device of any of Examples 10-13, in which each support pad within the plurality of support pads engages a holder retaining the adjacent support pad of the plurality of support pads.

Example 15 includes the CPR device of Example 14, in which the holder is further configured to at least partially surround a portion of the support structure.

Example 16 includes the CPR device of any of Examples 10-15, in which the plurality of support pads comprises a plurality of inflatable support pads.

Example 17 includes the CPR device of any of Examples 10-15, in which the plurality of support pads comprises a plurality of foam support pads.

Example 18 includes the CPR device of any of Examples 10-15, in which the plurality of support pads comprises a plurality of inflatable support pads containing a foam support pad.

Example 19 includes the CPR device of any of Examples 10-18, in which the plurality of support pads is affixed to the support structure.

Example 20 includes the CPR device of any of Examples 10-18, in which the plurality of support pads is removably attached to the support structure.

Example 21 includes the CPR device of any of Examples 10-20, in which the plurality of support pads is disposed at a junction between the leg and the base member.

The previously described versions of the disclosed subject matter have many advantages that were either described or would be apparent to a person of ordinary skill. Even so, all of these advantages or features are not required in all versions of the disclosed apparatus, systems, or methods.

Additionally, this written description makes reference to particular features. It is to be understood that the disclosure in this specification includes all possible combinations of those particular features. For example, where a particular feature is disclosed in the context of a particular aspect or embodiment, that feature can also be used, to the extent possible, in the context of other aspects and embodiments.

Also, when reference is made in this application to a method having two or more defined steps or operations, the defined steps or operations can be carried out in any order or simultaneously, unless the context excludes those possibilities.

Furthermore, the term "comprises" and its grammatical equivalents are used in this application to mean that other components, features, steps, processes, operations, etc. are optionally present. For example, an article "comprising" or "which comprises" components A, B, and C can contain only components A, B, and C, or it can contain components A, B, and C along with one or more other components.

Although specific embodiments have been illustrated and described for purposes of illustration, it will be understood that various modifications may be made without departing from the spirit and scope of the disclosure. Accordingly, the invention should not be limited except as by the appended claims.

The invention claimed is:

1. A cardiopulmonary resuscitation ("CPR") device, comprising:

a chest compression mechanism configured to deliver CPR chest compressions to a patient;

a support structure comprising:

a base member configured to be placed underneath the patient, and a leg configured to support the chest compression mechanism at a distance from the base member; and a plurality of support pads configured to provide lateral support to the patient's chest during use of the CPR device, each support pad within the plurality of support pads being coupled to an adjacent support pad of the plurality of support pads, each support pad within the plurality of support pads comprising a holder configured to retain and substantially surround the adjacent support pad of the plurality of support pads.

2. The CPR device of claim 1, further comprising a support pad affixed to the support structure.

3. The CPR device of claim 1, further comprising a support pad removably attached to the support structure.

4. The CPR device of claim 1, further comprising a support pad configured to at least partially surround a portion of the support structure.

5. The CPR device of claim 1, in which the plurality of support pads comprises a plurality of inflatable support pads.

6. The CPR device of claim 1, in which the plurality of support pads comprises a plurality of foam support pads.

7. The CPR device of claim 1, in which the plurality of support pads comprises a plurality of inflatable support pads containing a foam support pad.

8. The CPR device of claim 1, in which the plurality of support pads is disposed at a junction between the leg and the base member.

9. A cardiopulmonary resuscitation ("CPR") device, comprising:

a chest compression mechanism configured to deliver CPR chest compressions to a patient;

a support structure comprising:

a base member configured to be placed underneath the patient, and a leg configured to support the chest compression mechanism at a distance from the base member; and a plurality of support pads configured to provide lateral support to the patient's chest during use of the CPR device, each support pad within the plurality of support pads being coupled to an adjacent support pad of the plurality of support pads, each support pad within the plurality of support pads comprising a clip portion affixed to a pad portion, the clip portion configured to retain and substantially surround the adjacent support pad of the plurality of support pads.

10. The CPR device of claim 9, further comprising a support pad affixed to the support structure.

11. The CPR device of claim 9, further comprising a support pad removably attached to the support structure.

12. The CPR device of claim 9, further comprising a support pad configured to at least partially surround a portion of the support structure.

13. The CPR device of claim 9, in which the plurality of support pads comprises a plurality of inflatable support pads.

14. The CPR device of claim 9, in which the plurality of support pads comprises a plurality of foam support pads.

15. The CPR device of claim 9, in which the plurality of support pads comprises a plurality of inflatable support pads containing a foam support pad.

16. The CPR device of claim 9, in which the plurality of support pads is disposed at a junction between the leg and the base member.

* * * * *